US011199165B2

(12) United States Patent
Kimura et al.

(10) Patent No.: US 11,199,165 B2
(45) Date of Patent: Dec. 14, 2021

(54) INTAKE DUCT FOR INTERNAL COMBUSTION ENGINE

(71) Applicant: TOYOTA BOSHOKU KABUSHIKI KAISHA, Aichi-ken (JP)

(72) Inventors: Ryusuke Kimura, Ichinomiya (JP); Tomoyo Ohno, Nagoya (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 113 days.

(21) Appl. No.: 16/715,324

(22) Filed: Dec. 16, 2019

(65) Prior Publication Data

US 2020/0200129 A1 Jun. 25, 2020

(30) Foreign Application Priority Data

Dec. 25, 2018 (JP) ..... JP2018-240829

(51) Int. Cl.
*F02M 35/10* (2006.01)
*F02M 35/112* (2006.01)

(52) U.S. Cl.
CPC ..... *F02M 35/10321* (2013.01); *F02M 35/10347* (2013.01); *F02M 35/1036* (2013.01); *F02M 35/10144* (2013.01); *F02M 35/112* (2013.01); *F05C 2225/08* (2013.01)

(58) Field of Classification Search
CPC ..... F02M 35/10321; F02M 35/10347; F02M 35/112; F02M 35/10144; F02M 35/1036; F02M 35/10; F02M 35/10295; F05C 2225/08
See application file for complete search history.

(56) References Cited

U.S. PATENT DOCUMENTS 6,553,953 B1 * 4/2003 Fujihara ..... F02M 35/10347 123/184.21
7,802,651 B2 * 9/2010 Park ..... F02M 35/1272 181/224
2012/0292127 A1 * 11/2012 Teshima ..... F02M 35/1216 181/224

FOREIGN PATENT DOCUMENTS

JP 2017-203385 11/2017

* cited by examiner

*Primary Examiner* — Jacob M Amick
*Assistant Examiner* — Charles J Brauch
(74) *Attorney, Agent, or Firm* — Greenblum & Bernstein, P.L.C.

(57) ABSTRACT

An intake duct for an internal combustion engine includes a pipe-shaped shell. The shell includes a first molded product and a second molded product. The first molded product is formed by a plastic molded product and includes an opening extending through the first molded product in the thickness direction. The second molded product is formed by a fiber molded product produced through compression molding. The second molded product includes an air-permeable fitting projection fitted into the opening, and the second molded product is joined with an outer surface of the first molded product.

7 Claims, 5 Drawing Sheets

INTAKE DUCT FOR INTERNAL COMBUSTION ENGINE

BACKGROUND

1. Field

The present disclosure relates to an intake duct for an internal combustion engine.

2. Description of Related Art

A known intake duct for an internal combustion engine of a vehicle includes a side wall formed by a fiber molded product of a nonwoven fabric or the like in order to reduce intake noise (refer to Japanese Laid-Open Patent Publication No. 2017-203385).

The intake duct described in the publication includes a duct body formed by two segments separated in the circumferential direction. Each segment is semi-cylindrical. The segments are each formed by a nonwoven fabric made of synthetic resin fibers. A joint that is made of a hard plastic and joins the segments is arranged between the two segments. The joint includes a middle portion located between the two segments, an outer portion continuous with the middle portion and joined with the outer surfaces of the two segments, and an inner portion continuous with the middle portion and joined with the inner surfaces of the two segments. Thus, the joint has an H-shaped cross section.

In the intake duct described in the above publication, the joint increases the rigidity of the duct body. However, the inner surface of the joint forms a step on the inner surface of the duct body. The step increases a flow resistance acting on the intake air flowing inside the intake duct.

SUMMARY

It is an objective of the present disclosure to provide an intake duct for an internal combustion engine that limits increases in the flow resistance while ensuring rigidity.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a first general aspect, an intake duct for an internal combustion engine that achieves the above objective includes a pipe-shaped shell including a first molded product formed by a plastic molded product and including an opening extending through the first molded product in a thickness direction, and a second molded product formed by a fiber molded product produced through compression molding. The second molded product includes an air-permeable fitting projection fitted into the opening, and the second molded product is joined with an outer surface of the first molded product.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

One embodiment of an intake duct for an internal combustion engine (hereafter referred to as the intake duct 10) will now be described with reference to FIGS. 1A to 4.

Figure 1A:
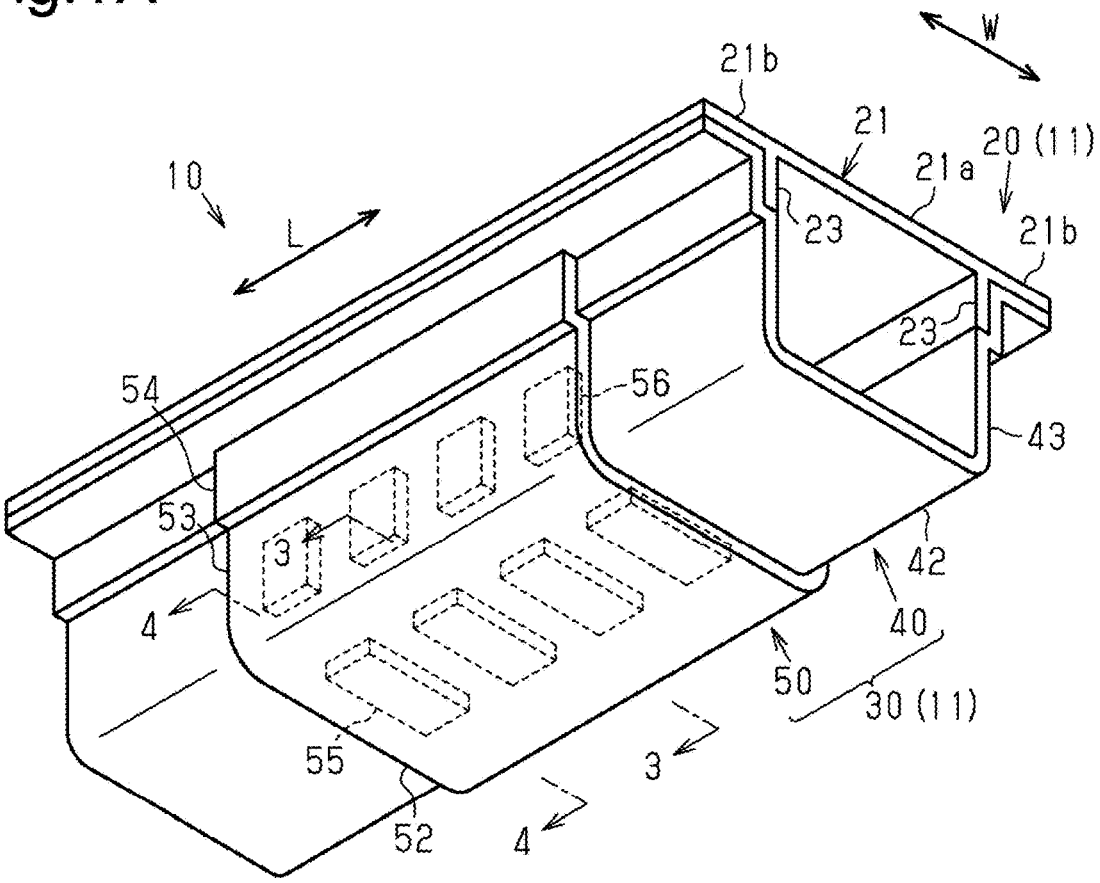
FIG. 1A is a perspective view showing one embodiment of an intake duct for an internal combustion engine.
Figure 2:
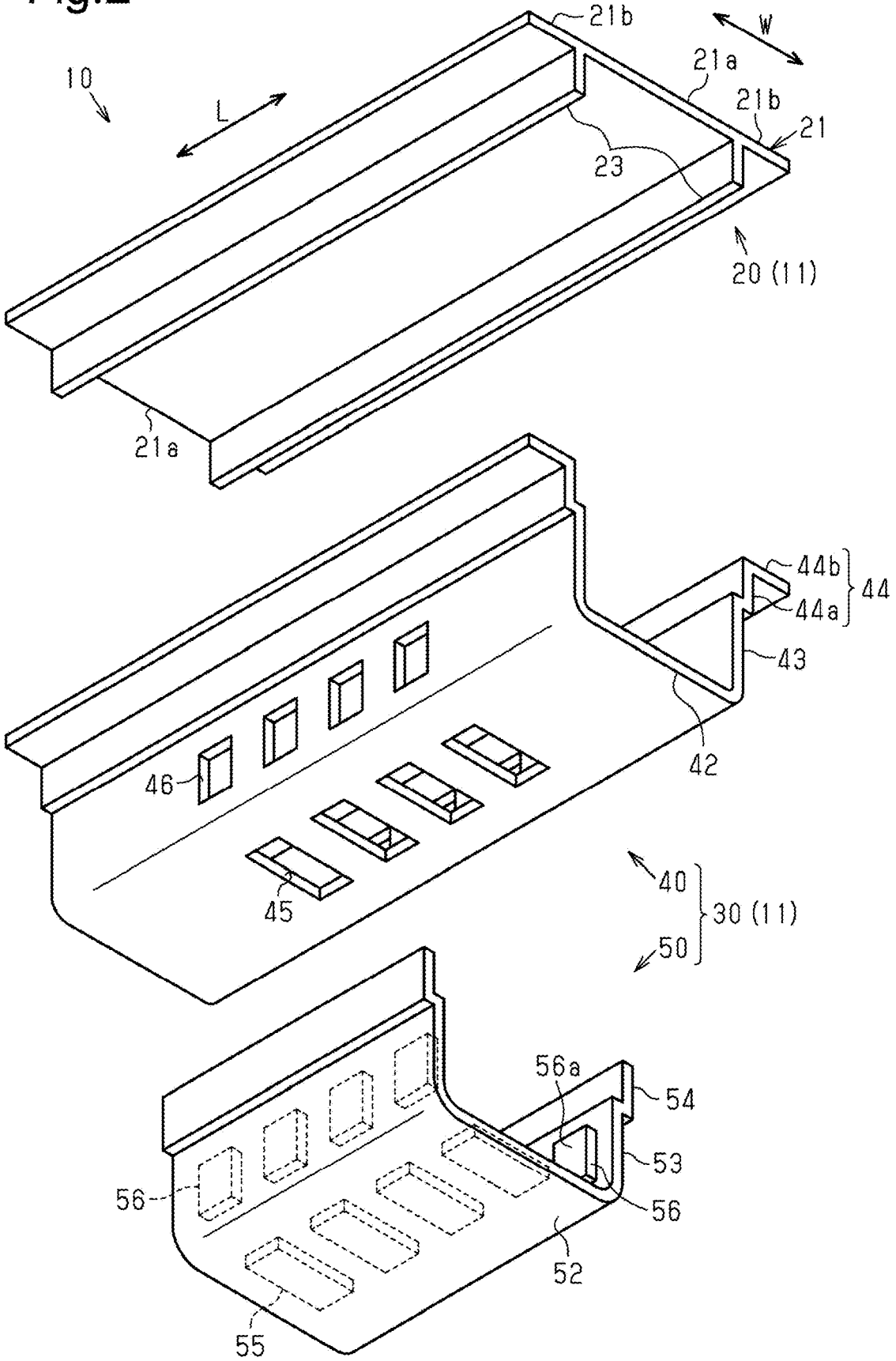
FIG. 2 is an exploded perspective view of the intake duct showing a first segment, a first molded product, and a second molded product spaced apart from one another.

As shown in FIGS. 1A and 2, the intake duct 10 includes a substantially square pipe-shaped shell 11. The central axis of the shell 11 of the present embodiment extends straight. Axial direction L and the circumferential direction of the shell 11 will hereafter simply be referred to as axial direction L and the circumferential direction, respectively.

The shell 11 includes a first segment 20 and a second segment 30 that are formed by separating the shell 11 into two in the circumferential direction.

First Segment 20

As shown in FIGS. 1A and 2 to 4, the first segment 20 is formed by a fiber molded product produced through compression molding and includes a rectangular and flat top wall 21. The top wall 21 includes a long side extending in axial direction L and a short side extending in a direction (right-left direction in FIG. 3) hereafter referred to as widthwise direction W.

Two joining portions 23 project toward the second segment 30 from portions of the top wall 21 that are located inward from the two ends 21*b* in widthwise direction W. The joining portions 23 each extend over the entire shell 11 in axial direction L (refer to FIG. 2).

Two ends 21*a* in axial direction L, the two ends 21*b* in widthwise direction W, and the two joining portions 23 of the top wall 21 are air-impermeable and high-compression portions.

Figure 1B:
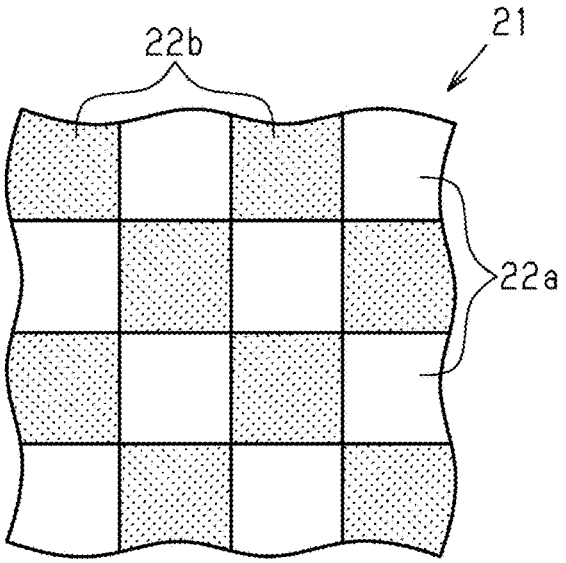
FIG. 1B is a plan view showing an outer surface of a first segment of the intake duct in FIG. 1A.
Figure 3:
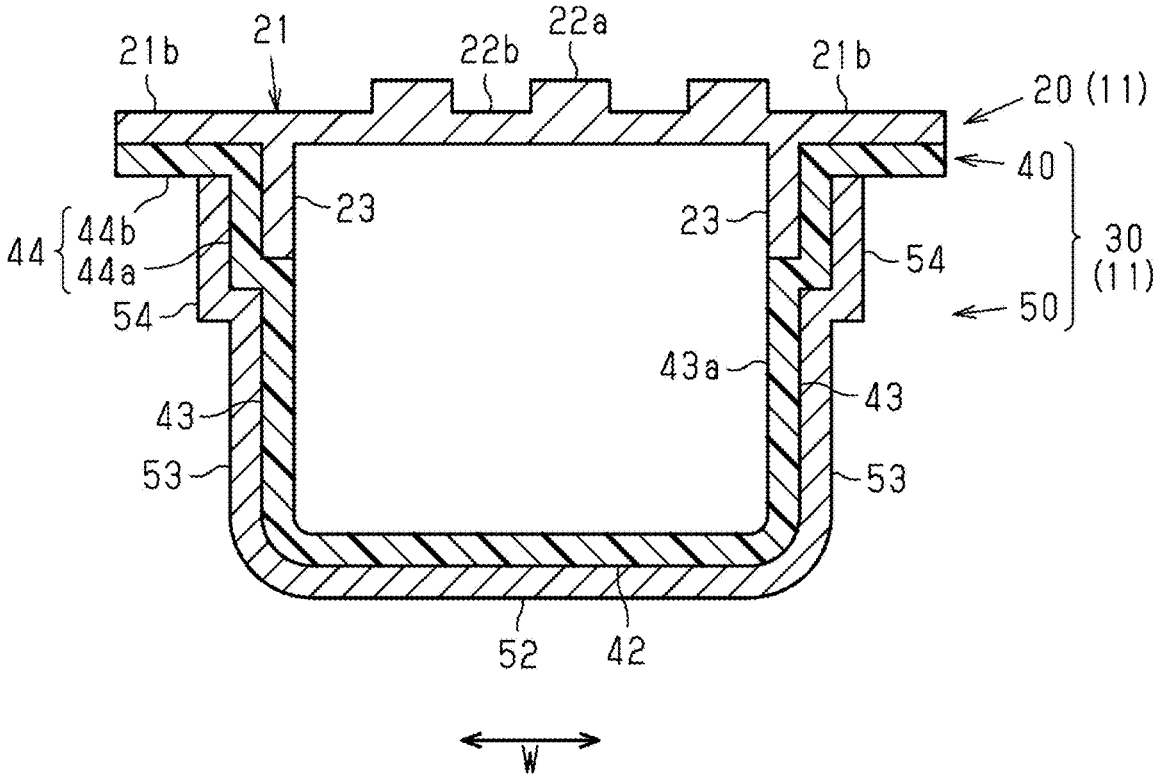
FIG. 3 is a cross-sectional view taken along line 3-3 in FIG. 1A.
Figure 4:
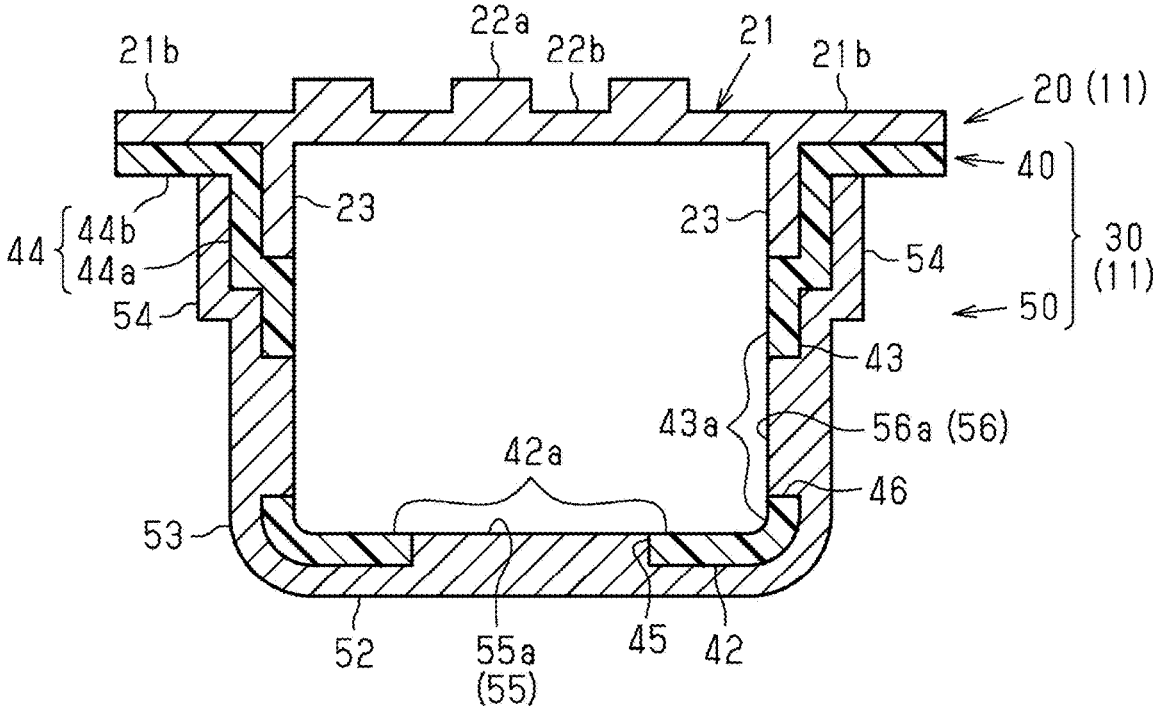
FIG. 4 is a cross-sectional view taken along line 4-4 in FIG. 1A.

As shown in FIGS. 1B, 3, and 4, the part of the top wall 21 surrounded by the two ends 21*a* in axial direction L and the two ends 21*b* in widthwise direction W includes air-permeable and low-compression portions 22*a* and air-impermeable and high-compression portions 22*b* that are compressed to a higher degree than the low-compression portions 22*a*.

The low-compression portions 22*a* and the high-compression portions 22*b* form a continuously stepped outer surface of the first segment 20 and a continuously flat inner surface of the first segment 20.

In the present embodiment, the low-compression portions 22*a* and the high-compression portions 22*b* are square and of the same size in a plan view and arranged alternately in a checkered pattern.

Second Segment 30

As shown in FIGS. 1A and 2 to 4, the second segment 30 includes a first molded product 40 and a second molded product 50. The first molded product 40 is formed by a plastic molded product. The second molded product 50 is formed by a fiber molded product produced through compression molding and joined with the outer surface of the first molded product 40.

First Molded Product 40

As shown in FIGS. 2 to 4, the first molded product 40 includes a bottom wall 42, two opposing walls 43, and two flanges 44. The bottom wall 42 is opposed to the top wall 21 of the first segment 20. The two opposing walls 43 are bent from two side edges of the bottom wall 42 in widthwise direction W, extended toward the two joining portions 23 of the first segment 20, and opposed to each other. The two flanges 44 are bent outward and extended in widthwise direction W from the two opposing walls 43.

As shown in FIGS. 2 and 3, a plurality of (four in present embodiment) rectangular openings 45 extend through the bottom wall 42 in the thickness direction. The openings 45 are arranged at intervals in axial direction L.

A plurality of (four in present embodiment) rectangular openings 46 extend through each of the opposing walls 43 in the thickness direction. In each opposing wall 43, the openings 46 are arranged at intervals in axial direction L.

An inner surface 43*a* of each opposing wall 43 of the first molded product 40 is flush with the inner surface of the corresponding joining portion 23 of the first segment 20.

The flanges 44 each include a first joining portion 44*a* that is joined with the outer surface of the corresponding joining portion 23 and a second joining portion 44*b* that is bent from the first joining portion 44*a* and extended outward in widthwise direction W. The second joining portion 44*b* of each flange 44 is joined with the corresponding end 21*b* of the top wall 21 in widthwise direction W. Each flange 44 extends over the entire first molded product 40 in axial direction L.

The joining portions 23 and the two ends 21*b* of the first segment 20 are joined with the joining portions 44*a*, 44*b* of the first molded product 40 by adhesive or the like.

Second Molded Product 50

As shown in FIGS. 2 to 4, the second molded product 50 includes a bottom portion 52, two side portions 53, and two extended portions 54. The bottom portion 52 covers the outer surface of the bottom wall 42 of the first molded product 40. The two side portions 53 are bent and extended from two side edges of the bottom portion 52 in widthwise direction W. The two extended portions 54 extend from the two side portions 53. The side portions 53 each cover the outer surface of the corresponding opposing wall 43 of the first molded product 40. The extended portions 54 each cover the outer surface of the corresponding first joining portion 44*a* of the first molded product 40.

The inner surface of the second molded product 50 is joined with the outer surfaces of the bottom wall 42 and the two opposing walls 43 of the first molded product 40 by adhesive or the like.

Air-permeable fitting projections 55 are arranged on the inner surface of the bottom portion 52 of the second molded product 50. The fitting projections 55 are fitted into the openings 45, which are arranged in the bottom wall 42 of the first molded product 40.

Air-permeable fitting projections 56 are arranged on the inner surfaces of the two side portions 53 of the second molded product 50. The fitting projections 56 are fitted into the openings 46, which are arranged in the two opposing walls 43 of the first molded product 40. The fitting projections 55 are shaped in correspondence with the openings 45. The fitting projections 56 are shaped in correspondence with the openings 46.

The fitting projections 55, 56 of the second molded product 50 are air-permeable and low-compression portions. Portions of the second molded product 50 excluding the fitting projections 55, 56 are air-impermeable and high-compression portions that are compressed to a higher degree than the fitting projections 55, 56.

As shown in FIG. 4, a projection end surface 55*a* of each fitting projection 55 is flush with an inner surface 42*a* of the first molded product 40 that is adjacent to the fitting projection 55. A projection end surface 56*a* of each fitting projection 56 is flush with the inner surface 43*a* of the first molded product 40 that is adjacent to the fitting projection 56.

The structure of a fiber molded product forming the first segment 20 and the second molded product 50 will now described.

The fiber molded product is formed by a nonwoven fabric made of bicomponent fibers of known sheath-core type including cores (not shown) containing, for example, polyethylene terephthalate (PET) and sheaths (not shown) containing modified PET having a melting point lower than that of the PET fibers of the cores and a nonwoven fabric made of PET fibers. The modified PET, which is contained in the sheaths of the bicomponent fibers, serves as a binder that binds fibers together.

Preferably, the mixing percentage of the modified PET is 30 to 70%. In the present embodiment, the mixing percentage of the modified PET is set to 50%.

The bicomponent fibers may contain polypropylene (PP) having a melting point lower than that of PET.

Preferably, the weight per unit area of the fiber molded product is 500 to 1500 g/m$^2$. In the present embodiment, the weight per unit area of the fiber molded product is set to 800 g/m$^2$.

The first segment 20 and the second molded product 50 are molded by thermal compressing (hot pressing) a sheet of the nonwoven fabric that has a predetermined thickness (30 to 100 mm).

The air permeability (as defined in JIS L 1096, A-method (Frazier method)) of the high-compression portion is approximately 0 cm$^3$/cm$^2$·s. Preferably, the thickness of the high-compression portion is 0.5 to 1.5 mm. In the present embodiment, the thickness of the high-compression portion is set to 0.7 mm.

The air permeability of the low-compression portion is set to 3 cm$^3$/cm$^2$·s. Preferably, the thickness of the low-compression portion is 0.8 to 3.0 mm. In the present embodiment, the thickness of the low-compression portion is set to 1.0 mm.

The present embodiment has the advantages described below.

(1) The shell 11 of the intake duct 10 includes the first molded product 40, which is formed by a plastic molded product, and the second molded product 50, which is formed by a fiber molded product produced through compression molding. The first molded product 40 includes the openings 45, 46, which extend through the first molded product 40 in the thickness direction. The second molded product 50 includes the air-permeable fitting projections 55, 56 fitted into the openings 45, 46. The second molded product 50 is also joined with the outer surface of the first molded product 40.

With this structure, portions of the second molded product 50, which is formed by a fiber molded product produced through compression molding, surrounding the air-permeable fitting projections 55, 56 are joined with the outer surface of the first molded product 40, which is formed by a plastic molded product. This improves the rigidity of the shell 11 while partially forming the shell 11 of the intake duct 10 with the fitting projections 55, 56, which are formed by a fiber molded product.

With this structure, the fitting projections 55, 56 of the second molded product 50 are fitted into the openings 45, 46 of the first molded product 40. This reduces steps formed on the inner surface of the shell 11 by the formation of the openings 45, 46 as compared to when the second molded product 50 does not include the fitting projections 55, 56. Thus, an increase in flow resistance is limited while the rigidity of the shell 11 is ensured.

(2) The projection end surface 55*a* of each fitting projection 55 is flush with the inner surface 42*a* of the first molded product 40 that is adjacent to the fitting projection 55. The projection end surface 56*a* of each fitting projection 56 is flush with the inner surface 43*a* of the first molded product 40 that is adjacent to the fitting projection 56.

This structure eliminates steps from the inner surface of the shell 11 between the projection end surface 55*a* of the fitting projection 55 of the second molded product 50 and the inner surface 42*a* of the first molded product 40 that is adjacent to the fitting projection 55. The structure also eliminates steps from the inner surface of the shell 11 between the projection end surface 56*a* of the fitting projection 56 of the second molded product 50 and the inner surface 43*a* of the first molded product 40 that is adjacent to the fitting projection 56. This further limits increases in the flow resistance.

(3) The shell 11 includes the first segment 20 and the second segment 30 that are formed by separating the shell 11 into two parts in the circumferential direction. The first segment 20 is formed by a fiber molded product produced through compression molding and includes the air-permeable and low-compression portions 22*a* and the high-compression portions 22*b* that are compressed to a higher degree than the low-compression portions 22*a*. The second segment 30 includes the first molded product 40 and the second molded product 50.

With this structure, the air-permeable and low-compression portions 22*a* arranged in the first segment 20 reduce intake noise, and the high-compression portions 22*b* improve the rigidity of the first segment 20. The second segment 30 includes the first molded product 40 and the second molded product 50. Thus, the air-permeable fitting projections 55, 56 reduce intake noise and ensure the rigidity of the second segment 30. Accordingly, intake noise is reduced and the rigidity of the entire shell 11 of the intake duct 10 is increased.

The low-compression portions 22*a* and the high-compression portions 22*b* are regularly arranged. This improves the design of the first segment 20.

(4) The first molded product 40 includes the bottom wall 42, the two opposing walls 43 that are bent and extended from the two side edges of the bottom wall 42 and opposed to each other, and the two flanges 44 that are bent and extended from the two opposing walls 43. The two flanges 44 are joined with the first segment 20. The second molded product 50 is joined with the outer surfaces of the bottom wall 42 and the two opposing walls 43 of the first molded product 40.

In this structure, the first molded product 40 includes the bottom wall 42, the two opposing walls 43, and the two flanges 44 so that the first molded product 40 has a hat-shaped cross section. This further increases the rigidity of the first molded product 40. The second molded product 50 is joined with the outer surfaces of the bottom wall 42 and the two opposing walls 43 of the first molded product 40. This further increases the rigidity of the shell 11 of the intake duct 10.

(5) The openings 45 extend through the bottom wall 42. The openings 46 extend through the two opposing walls 43. The second molded product 50 includes the fitting projections 55 fitted into the corresponding openings 45 and the fitting projections 56 fitted into the corresponding openings 46.

In this structure, the fitting projections 55, 56 are arranged at multiple locations on the second molded product 50. This further reduces intake noise.

MODIFICATION

The above-described embodiment may be modified as follows. The present embodiment and the following modification can be combined as long as the combined modifications are not in contradiction. In the following description, like or the same reference numerals are given to those components that are like or the same as the corresponding components of the above embodiment, and detailed explanations are omitted. In the modification shown in FIGS. 5A and 5B, components corresponding to the components of the above embodiment are denoted by reference numbers obtained by adding 100 to the reference numbers used in the above embodiment and shown as "1". Such components will not be described in detail. Likewise, in the modification shown in FIG. 6, components corresponding to the components of the above embodiment are denoted by reference numbers obtained by adding 200 to the reference numbers used in the above embodiment and shown as "2".

The shapes of the openings 45, 46 may be changed to be, for example, circular in a plan view. Alternatively, the openings 45, 46 may have different shapes. In this case, the fitting projections 55, 56 are shaped accordingly.

The openings may be arranged in only either one of the bottom wall 42 and the two opposing walls 43.

Figure 5A:
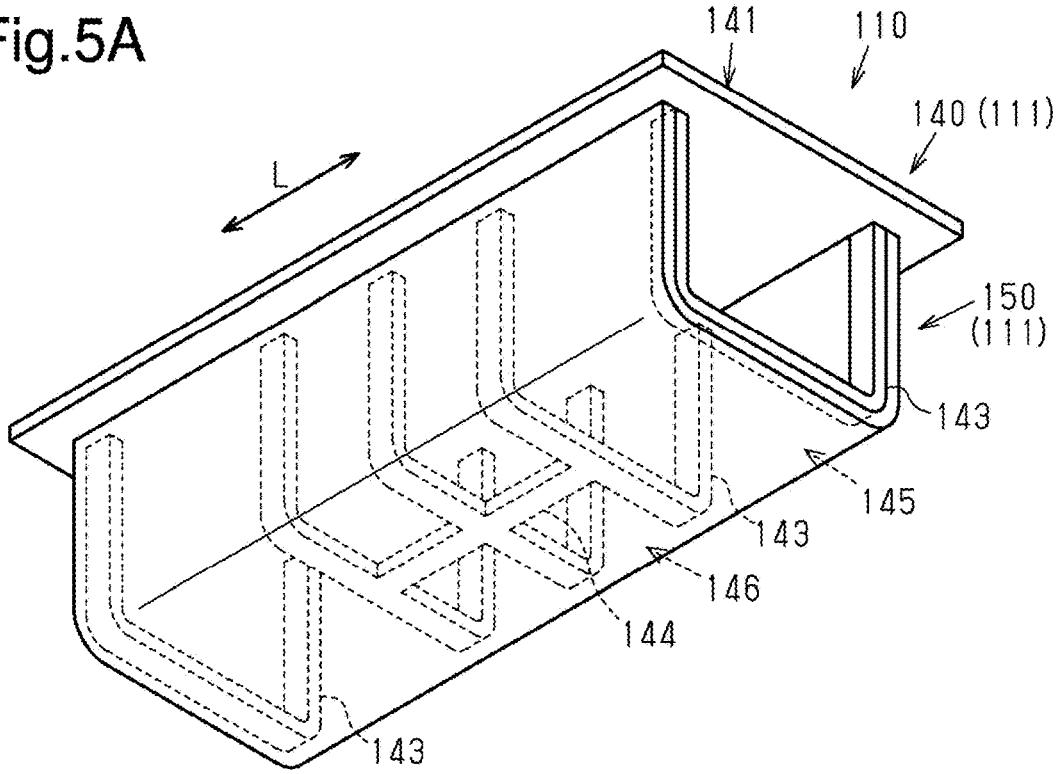
FIG. 5A is a perspective view entirely showing a modified intake duct.

FIG. 5A shows an intake duct 110 of a modification including a shell 111. The shell 111 includes a first molded product 140 formed by a plastic molded product and a second molded product 150 formed by a fiber molded product produced through compression molding. The first molded product 140 includes a top wall 141 and a plurality of (five in this example) frames 143 spaced apart from one another in axial direction L of the shell 111. Each frame 143 projects from one surface of the top wall 141 and forms a closed loop with the top wall 141. The three frames 143 located at the central portion in axial direction L include a connector 144 connecting bottom portions of adjacent frames 143.

Figure 5B:
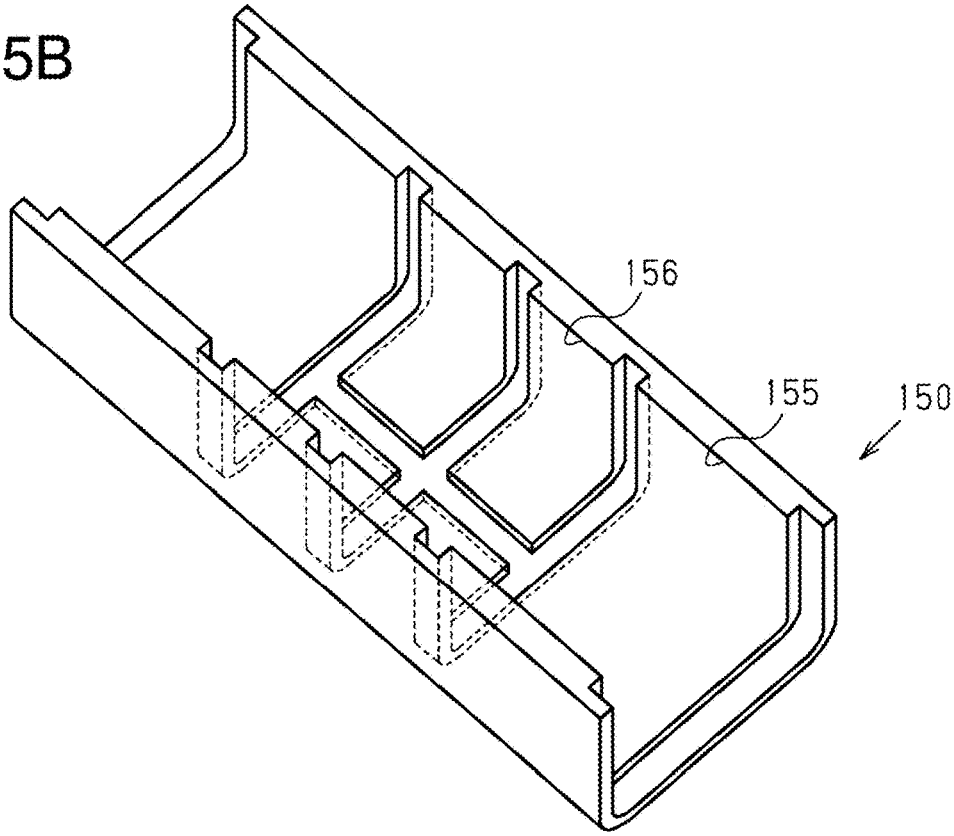
FIG. 5B is a perspective view showing an inner side of the second molded product in the intake duct of FIG. 5A.

As shown in FIG. 5B, the second molded product 150 is gutter-shaped and is joined with the outer surfaces of the frames 143. The inner surface of the second molded product 150 includes fitting projections 155, 156 fitted into openings 145, 146 extending between adjacent frames 143.

This structure enlarges the openings 145, 146. In other words, the structure enlarges the fitting projections 155, 156. This allows the air-permeable and low-compression portions to further reduce intake noise.

Figure 6:
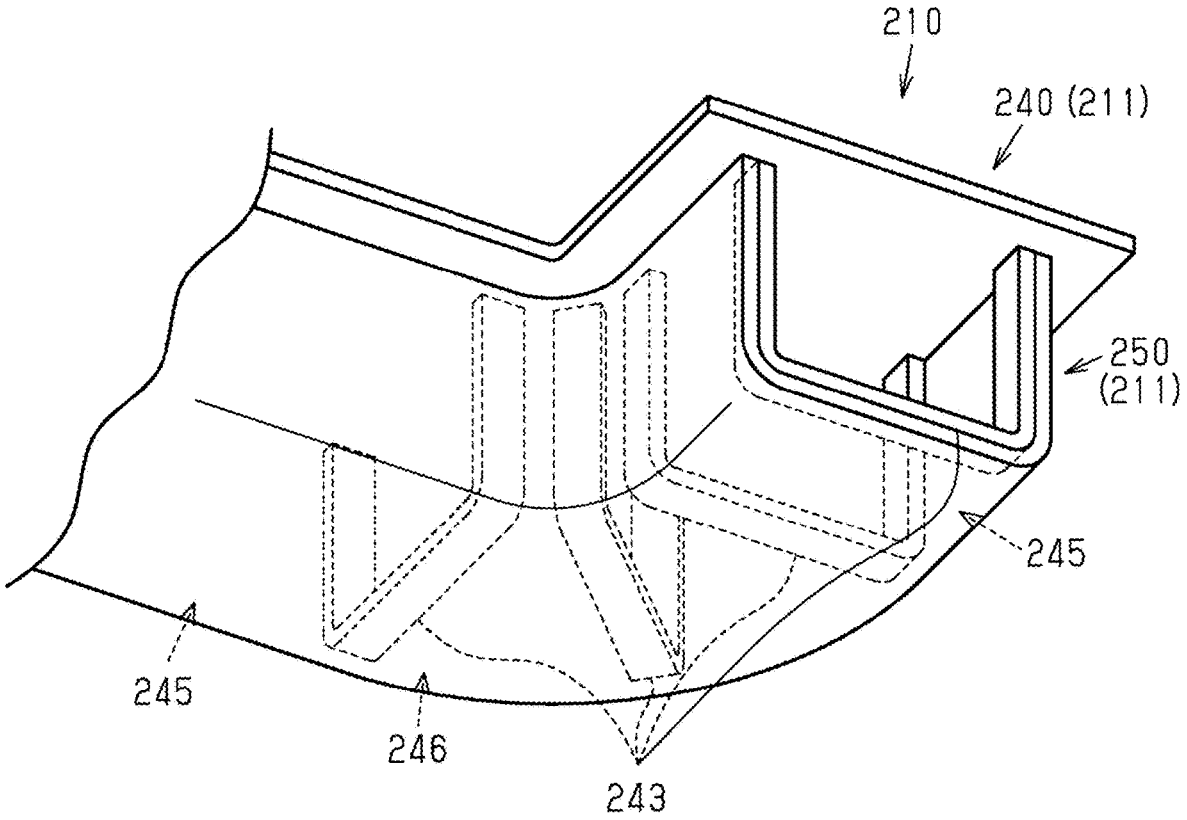
FIG. 6 is a perspective view showing another modified intake duct.

The shell 11 illustrated in the above embodiment and modification has a straight central axis. Instead, as shown in FIG. 6, an intake duct 210 may include a shell 211 having a curved central axis. In this case, frames 243 may be arranged at a curved portion where the curvature of the central axis of the shell 211 is large.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An intake duct for an internal combustion engine, the intake duct comprising:

a pipe-shaped shell including:

a first molded product formed by a plastic molded product and including an opening extending through the first molded product in a thickness direction, and a second molded product formed by a fiber molded product produced through compression molding, wherein the second molded product includes an air-permeable fitting projection fitted into the opening, and the second molded product is joined with an outer surface of the first molded product, wherein the air-permeable fitting projection is an air-permeable low-compression portion having a first thickness, the second molded product further includes an air-impermeable high-compression portion that is compressed to a higher degree than the air-permeable fitting projection, the air-impermeable high-compression portion having a second thickness that is smaller than the first thickness, and the air-impermeable high-compression portion is not fitted into the opening.

2. The intake duct according to claim 1, wherein the fitting projection includes a projection end surface that is flush with an inner surface of the first molded product adjacent to the fitting projection, and the inner surface of the first molded product defines a part of an inner surface of the intake duct.

3. The intake duct according to claim 1, wherein the shell includes a first segment and a second segment joined with the first segment in a circumferential direction, the first segment is formed by a fiber molded product produced through compression molding and includes an air-permeable and low-compression portion and a high-compression portion that is compressed to a higher degree than the low-compression portion, and the second segment includes the first molded product and the second molded product.

4. The intake duct according to claim 3, wherein the first molded product includes a bottom wall, two opposing walls that are bent and extended from two side edges of the bottom wall and opposed to each other, and two flanges that are bent and extended from the two opposing walls, the two flanges are joined with the first segment, the second molded product includes a bottom portion and two side portions, the two side portions being bent and extended from two side edges of the bottom portion, and the second molded product is joined with the outer surface of the first molded product such that the bottom portion of the second molded product covers the bottom wall of the first molded product and that each side portion of the second molded product covers a corresponding one of the opposing walls of the first molded product.

5. An intake duct for an internal combustion engine, the intake duct comprising:

a pipe-shaped shell including:

a first molded product formed by a plastic molded product and including an opening extending through the first molded product in a thickness direction, and a second molded product formed by a fiber molded product produced through compression molding, wherein the second molded product includes an air-permeable fitting projection fitted into the opening, and the second molded product is joined with an outer surface of the first molded product, wherein the shell includes a first segment and a second segment joined with the first segment in a circumferential direction, the first segment is formed by a fiber molded product produced through compression molding and includes an air-permeable and low-compression portion and a high-compression portion that is compressed to a higher degree than the low-compression portion, the second segment includes the first molded product and the second molded product, the first molded product includes a bottom wall, two opposing walls that are bent and extended from two side edges of the bottom wall and opposed to each other, and two flanges that are bent and extended from the two opposing walls, the two flanges are joined with the first segment, the second molded product is joined with outer surfaces of the bottom wall and the two opposing walls of the first molded product, the opening is one of a plurality of openings arranged in the bottom wall and in the opposing walls, and the fitting projection is one of a plurality of fitting projections arranged on the second molded product and fitted into the corresponding openings.

6. The intake duct according to claim 5, wherein the fitting projection includes a projection end surface that is flush with an inner surface of the first molded product adjacent to the fitting projection, and the inner surface of the first molded product defines a part of an inner surface of the intake duct.

7. The intake duct according to claim 2, wherein an inner surface of the air-impermeable high-compression portion of the second molded product contacts the outer surface of the first molded product.

* * * * *